US005614482A

United States Patent [19]

Baker et al.

[11] Patent Number: 5,614,482

[45] Date of Patent: Mar. 25, 1997

[54] LUBRICANT COMPOSITION FOR TREATMENT OF NON-FERROUS METALS AND PROCESS USING SAME

[75] Inventors: Bradley M. Baker, Monroe, N.C.; H. Lynn Parker, Spartanburg, S.C.

[73] Assignee: Parker Sales, Inc., Spartanburg, S.C.

[21] Appl. No.: 396,155

[22] Filed: Feb. 27, 1995

[51] Int. Cl.[6] ..... C10M 129/72

[52] U.S. Cl. ..... 508/496

[58] Field of Search ..... 252/49.5, 56 R, 252/56 S; 72/42; 508/465, 496, 506

[56] References Cited

U.S. PATENT DOCUMENTS

| | | | |
|---|---|---|---|
| 3,726,799 | 4/1973 | McDole et al. | 252/49.5 |
| 4,242,095 | 12/1980 | Carver . | |
| 4,496,632 | 1/1985 | Camp et al. . | |
| 4,673,524 | 6/1987 | Dean | 510/413 |
| 4,882,077 | 11/1989 | Cox | 508/463 |
| 4,915,859 | 4/1990 | Kerr et al. . | |
| 5,032,303 | 7/1991 | Bondpa . | |
| 5,096,501 | 3/1992 | Dishart et al. | 134/10 |
| 5,158,710 | 10/1992 | Van Eenam | 252/539 |
| 5,225,249 | 7/1993 | Biresaw et al. | 252/495 X |
| 5,320,767 | 6/1994 | Habeeb . | |

FOREIGN PATENT DOCUMENTS

| | | |
|---|---|---|
| 56-125496 | 10/1981 | Japan . |

*Primary Examiner*—Jacqueline V. Howard
*Assistant Examiner*—Cephia D. Toomer
*Attorney, Agent, or Firm*—Dority & Manning, P.A.

[57] ABSTRACT

A lubricant composition for treating non-ferrous metals and alloys is provided. In particular, the composition is used to treat metal substrates when the substrates are subjected to various metal working processes. The composition includes an emulsified ester that is combined with non-ferrous lubricating materials. The emulsified ester makes the lubricant water dispersible and therefore easily removable from the metal substrates after treatment. The composition of the present invention is extremely durable, biodegradable and environmentally safe.

26 Claims, 1 Drawing Sheet

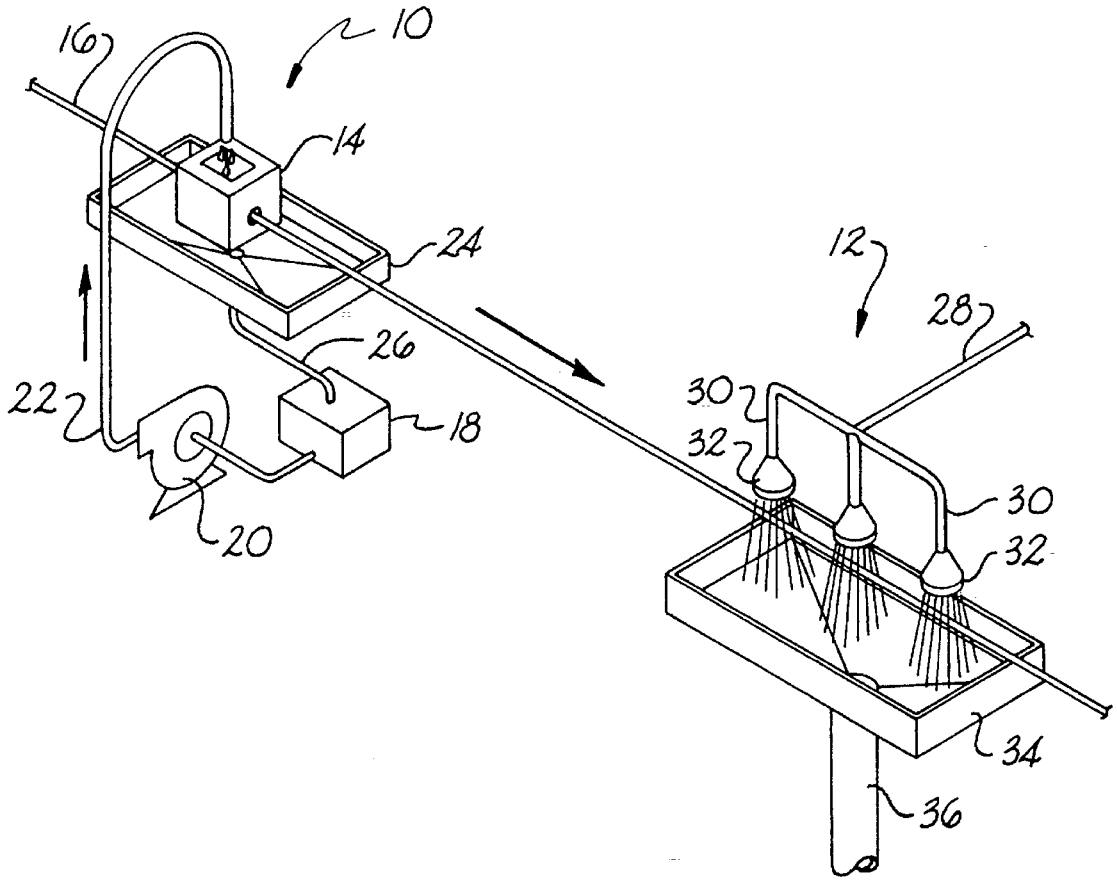
10
16
14
24
12
28
26
22
18
30
32
30
32
20
34
36

LUBRICANT COMPOSITION FOR TREATMENT OF NON-FERROUS METALS AND PROCESS USING SAME

BACKGROUND OF THE INVENTION

The present invention is generally directed to a composition for treating non-ferrous metals. More particularly, the present invention is directed to a lubricant composition for use on non-ferrous metals when the metals are incorporated into various metal working operations such as forming, cutting, stamping and drawing. The present invention is also directed to a process of using the lubricant composition.

Metal working generally refers to an assortment of processes used to produce metallic products by forming a metal substrate into a desired shape. The metal is forced to assume new shapes by the application of large mechanical forces, which may be applied to the material while it is either hot or cold. Besides producing desired shapes, metal working can also effect the structure and properties of most metals and alloys in a markedly favorable manner. Mechanical working can break down the original crystalline structure of the metal or alloy and replace it with a much finer and more satisfactory structure.

The term metal working refers to various operations including: forming, cutting, stamping, drawing and other similar processes. In all of these operations, the metallic substrate must be treated with a lubricant prior to being shaped. The particular lubricant chosen typically depends whether a ferrous or non-ferrous metal is being treated. Caustic or a similar alkaline solution is commonly used as a lubricant when working with ferrous metals. An alkaline solution, however, will etch and adversely effect most non-ferrous metals.

To treat non-ferrous metals, a lubricant is normally chosen that has a neutral to acidic pH. Unfortunately, currently most of the known and commercially accepted non-ferrous lubricants are water insoluble or immiscible with water. Further, because of having a high and unworkable viscosity, these lubricants are typically combined with a hydrocarbon oil or a mineral oil prior to application. The addition of an oil presents various problems. For instance, the resulting blends are environmentally hazardous making their disposal highly regulated and expensive.

Current non-ferrous lubricant solutions are also difficult to remove once they have been applied to the metal or alloy. Because they are water insoluble, the solutions must be removed using a solvent. In particular, chlorinated solvents such as 1,1,1-trichloroethane are often used. In removing the lubricant solutions from the metallic materials, the solvents are heated and vaporized. The processed metallic materials are placed in contact with the vapors to remove the lubricant solutions. This process is generally known in the industry as "vapor phase degreasing."

The solvents normally used in the above-described cleaning process are very dangerous. The solvents are not only poisonous to inhale but can be very flammable. Further, the vapor phase degreasing process creates a hazardous waste product that must be carefully disposed of under close government scrutiny. The costs involved in disposing these solvents are exorbitant.

The composition and process of the present invention offer many advantages, benefits and improvements over prior art methods. In general, the present invention is directed to a lubricant composition for use with non-ferrous metals in various metal working processes. The lubricant composition is environmentally safe, contains no hydrocarbon oils or mineral oils, and is more durable than prior art products. Further, the composition is water soluble and can be removed from a metallic material by washing the metallic materials with water. Being environmentally safe, after washing the metallic materials, the produced wastewater presents no disposal problems and can be released to a normal sewer line without pretreatment.

SUMMARY OF THE INVENTION

The present invention recognizes and addresses the foregoing disadvantages, and others of prior art constructions and methods.

Accordingly, it is an object of the present invention to provide a composition for lubricating metals and alloys during various metal working operations.

It is another object of the present invention to provide an improved metal working process using the lubricant composition.

Another object of the present invention is to provide a lubricant composition for the treatment of non-ferrous metals that is environmentally safe.

It is another object of the present invention to provide a lubricant composition for the treatment of non-ferrous metals that can be removed from the processed metals using only water.

A further object of the present invention is to provide a lubricant composition for the treatment of non-ferrous metals that can be removed from processed metals without creating a hazardous by-product.

These and other objects of the present invention are achieved by providing a composition for lubricating non-ferrous metallic materials during metal working processes such as forming, cutting, stamping and drawing. The composition includes at least one dialkyl or dibasic ester. An oil and a water emulsifier, added in an amount sufficient to emulsify the dialkyl ester, are blended with the ester to form an emulsion. The emulsion is then combined with a lubricant for a non-ferrous metal, hereinafter "non-ferrous lubricant," to form a lubricating composition. The resulting composition is biodegradable and water dispersible for use with non-ferrous metals and alloys.

In one embodiment, the dialkyl ester incorporated into the composition can include a mixture of dimethyl esters. The esters can be present within the composition in an amount from about 3 percent to about 20 percent by weight.

The water or aqueous emulsifier can be an ethoxylated oil or oil derivative. One example of a suitable water emulsifier for use in the present invention is an ethoxylated castor oil. The water emulsifier can be present within the composition in relation to the ester in a ratio within the range of approximately 0.5:1 to 1.5:1. The lubricant chosen for use in the composition, on the other hand, can include any non-ferrous lubricant, such as butyl stearate, esters of pentaerythritol, or a fatty acid ester, which will permit retention of a stable emulsion. The lubricant should be present within the composition in an amount sufficient to lubricate the non-ferrous metallic material for the particular metal working process. The amount of lubricant can range from about 40 percent to about 80 percent by weight.

The oil emulsifier can be an amine salt condensate and preferably an amine salt condensate of a sulfonic acid. The oil emulsifier can be added for facilitating the formation of the emulsion and for facilitating the mixing of the non-ferrous lubricant with the emulsion. On example of an oil emulsifier is an isopropylamine salt of dodecylbenzene sulfonic acid. The oil emulsifier can be present within the composition in relation to the dialkyl ester component in a ratio within the range of approximately 1.5:1 to 2.5:1.

These and other objects are also achieved by providing an improved lubricating composition for use in treating non-ferrous metallic materials during a metal working process. The composition which is biodegradable and may be removed from the metallic materials using only water includes a solvent and a lubricant, which initially is insoluble in water but in the present composition is water dispersible. The solvent must be capable of cleaning the metal surface of grime, grease, and the like, and preferably is an emulsified mixture of dimethyl esters. A water emulsifier, such as an ethoxylated castor oil, is employed for emulsifying the ester. The solvent can further include an oil emulsifier.

The lubricant is present within the present composition in an amount sufficient to lubricate the non-ferrous metals and alloys, while the solvent is present within the composition in an amount sufficient to make the resulting composition water dispersible. The solvent, e.g. dimethyl esters, can be present within the composition in an amount from about 5 percent to about 15 percent by weight, while the lubricant can be present in the composition in an amount from about 40 percent to about 70 percent by weight.

The present invention is also directed to a process for working non-ferrous metals and includes the steps of supplying a non-ferrous metal substrate. The substrate is contacted with a lubricating composition after which the metal is worked. In a metal drawing process by way of example, the lubricated non-ferrous metal substrate is forced through a die assembly which modifies the cross-sectional area of the substrate according to the dimension and shape of the die. The process can further include the step of washing and cleaning the lubricated non-ferrous metal substrate after being forced through the die assembly. Preferably, the substrate is washed with water to remove the lubricating composition therefrom.

Other objects, features, and aspects of the present invention are discussed in greater detail below.

BRIEF DESCRIPTION OF THE DRAWING

A full and enabling disclosure of the present invention, including the best mode thereof, to one of ordinary skill in the art, is set forth more particularly in the remainder of the specification, including reference to the accompanying FIGURE, in which:

The FIGURE is a side schematic view of a typical metal working process in which the composition of the present invention may be used.

Repeat use of reference characters in the present specification and drawing is intended to represent same or analogous features or elements of the invention.

DETAIL DESCRIPTION OF PREFERRED EMBODIMENTS

It is to be understood by one of ordinary skill in the art that the present discussion is a description of exemplary embodiments only, and is not intended as limiting the broader aspects of the present invention.

The present invention is generally directed to a lubricating composition for treating metals and alloys during various metal working operations. Such operations may include forming, cutting, stamping, drawing and the like or any metal working process where a non-ferrous metal is lubricated. Although the composition may be used to lubricate ferrous metals, the composition, being slightly acidic, is more directed to use with non-ferrous metals and alloys. Such metals are exemplified by aluminum, copper, copper alloys, zinc, nickel, nickel alloys, tin, silver, gold, magnesium, titanium and others.

The composition of the present invention basically comprises an emulsified ester blended with a non-ferrous lubricant. The non-ferrous lubricant incorporated into the present invention can include any known non-ferrous lubricant or commercially accepted lubricant which when present in the composition is easily removed by water. As described above, in the past, non-ferrous lubricants, due to being water insoluble and highly viscous, were mixed with hydrocarbon oils or mineral oils prior to use. The resulting oil based compositions were then only removable from the metals by using hazardous solvents, such as 1,1,1-trichloroethane, benzene and the like. By blending these lubricants with the emulsified esters according to the present invention, however, the resulting composition is not only water soluble but is completely environmentally safe.

The composition of the present invention contains no hydrocarbon oils and is biodegradable. The composition meets or exceeds all current federal standards for VOC, BOD and COD. The composition is non-hazardous and non-reportable to any government agency and can be discharged to any public waste treatment system. Further, the composition is water soluble making it removable from the metal substrate using only water. As used herein, a water soluble composition refers to a composition that is miscible with water or to a composition that can be removed from a surface using only water.

A further advantage to the present invention is that the lubricant composition is much more durable than prior art materials. Not containing any hydrocarbon oils, the composition of the present invention is not as prone to thermal degradation after repeated use. Further, since no oils are present, the composition offers a lower viscosity making it easier to pump and handle.

As stated above, a non-ferrous lubricant is combined with an emulsified ester to form the composition of the present invention. More particularly, the ester used in the present invention is a short chain alcohol ester, a dialkyl ester, a dibasic ester or mixtures thereof. As used herein, a dibasic ester refers to an ester having two alkyl groups attached thereto. Preferably, the alkyl groups contain from about one to about five carbon atoms. A group of esters particularly well suited for use in the lubricating composition are dimethyl esters such as dimethyl adipate, dimethyl succinate, and dimethyl glutarate. A suitable mixture of dimethyl esters can be obtained commercially from Alko America, a division of BaCall Industries, Inc., located in Lancaster, S.C. The name of the product marketed by Alko America is Alkosurf 718.

The primary reason for adding the esters to the composition of the present invention is for use as a solvent. Non-ferrous lubricants, in their raw state, do not have the proper consistency for direct application to metal substrates. In particular, the lubricants are very thick and hard to handle. As opposed to adding hydrocarbon oils to the lubricants as was past practice, the present invention is directed to combining the lubricants with the above-described esters. The esters improve the handleability of the lubricants making them more workable and pumpable.

Although dependent upon the other materials chosen, the dialkyl esters can be present in the lubricating composition in an amount from about 3 percent to about 20 percent by weight. Preferably, the esters are present in an amount from about 5 percent to about 15 percent by weight, and most preferably between about 8 percent to about 10 percent by weight. Of course, the actual amount used will depend on many factors including the particular non-ferrous metal to be treated and the non-ferrous lubricant incorporated into the composition.

Before being combined with a non-ferrous lubricant, the selected dialkyl esters are emulsified using a dual emulsifier system. In particular,, the esters are emulsified with an oil emulsifier and a water emulsifier. The oil emulsifier and the water emulsifier are preferably mixed together first before being combined with the esters.

Besides emulsifying the dialkyl esters, the oil emulsifier is primarily added to the composition in order to facilitate the blending of the dialkyl esters with the non-ferrous lubricant. The oil emulsifier serves as an oil dispersant. Specifically, the oil emulsifier can be an anionic surfactant such as an amine salt condensate and preferably an amine salt condensate of a sulfonic acid. Particular examples would include an amine salt of methyl benzene sulfonic acid or an isopropylamine salt of dodecylbenzene sulfonic acid. It is also believed that trimethylanolamine may also function adequately as the oil emulsifier.

Thus far, the most optimum results have been found when the oil emulsifier is present in the composition in relation to the dialkyl ester in a weight ratio within the range of approximately of 1.5:1 to 2.5:1. Most preferably, the oil emulsifier is present in relation to the dialkyl ester in a ratio of about 2 to 1.

The water emulsifier, on the other hand, is added in order to make the resulting composition water soluble or at least removable from a surface using only water. In other words, the water emulsifier makes the lubricant composition water dispersible. Specifically, the water emulsifier can be a non-ionic ethoxylated oil or oil derivative. Preferably, the emulsifier has an HLB value of between about 10 to about 12. An HLB value refers to the solubility of a material.

Of concern is that the water emulsifier or a mixture of the water emulsifier and oil emulsifier do not hydrolyze the dialkyl esters. Specific examples of compounds that can be used as a water emulsifier include an ethoxylated castor oil, an ethoxylated phenol, such as an ethoxylated nonyl phenol or an ethoxylated octyl phenol, or an ethoxylated phosphate. Preferably, the water emulsifier chosen is biodegradable and environmentally safe. As such, most preferably, an ethoxylated castor oil is used. One particular ethoxylated castor oil that is well suited for use in the present invention has 36 moles of ethylene oxide attached.

When using an ethoxylated castor oil, the emulsifier can be added to the dialkyl esters in a weight ratio within the range of approximately 0.5:1 to 1.5:1. Preferably, the water emulsifier and esters are added in a ratio of approximately 1 to 1.

Once the dialkyl or dibasic ester component is emulsified, the resulting emulsion is combined with a non-ferrous lubricant. As described above, traditional non-ferrous lubricants are typically water insoluble. When a non-ferrous lubricant, however, is combined with the emulsified esters, the resulting composition is water dispersible, making it easily removable from metallic substrates using only water. Further, the resulting composition is environmentally safe alleviating many of the hazardous disposal requirements of prior art systems. In terms of performance, the composition of the present invention satisfactorily lubricates metallic substrates subjected to metal working procedures. In fact, the composition of the present invention has been proven to be more durable than many prior art products.

Thus far, it has been found than any known non-ferrous lubricant may be added to the emulsified ester solvent. Specific examples of non-ferrous lubricants that may be used in the present invention include n-butyl stearate (butyl esters of stearic acid), esters of pentaerythritol, any shorter chain fatty acid esters, such as those containing less than 20 carbon atoms, capriclic acid esters, trimethylpropane esters, or dimer diol esters. One commercially available product that may be used in the present invention is PELEGONATE marketed by Henkle Corporation of Charlotte, N.C., which contains esteems of pentaerythritol. A lubricant containing esters of pentaerythritol is particularly preferred due to its broad range of operating temperatures (about 0° F. to 400° F.).

The particular non-ferrous lubricant selected for incorporation into the lubricating composition will depend upon many factors. Such factors may include the particular metal or alloy being processed, the process temperatures, the particular metal working operation in which the composition is to be used, or the compatibility of the lubricant with the machine or die assembly in which the lubricant is to be used.

Generally speaking, the non-ferrous lubricant should be present within the composition in an amount effective to lubricate the particular non-ferrous metal or alloy. This amount will typically be between about 40 percent to about 80 percent by weight of the composition. Preferably, the non-ferrous lubricant is present in an amount from about 40 percent to about 65 percent by weight. The upper limit of the amount of the non-ferrous lubricant added, however, may be determined by the amount of the emulsified ester that needs to be added to the lubricant in order to make the resulting composition water dispersible.

The lubricating composition of the present invention can be used to treat various non-ferrous metals and alloys prior to and during any metal working process. The composition is slightly acidic making it well adapted for use with non-ferrous metals. Although not necessary, in one embodiment, wintergreen or another similar material can be added to the composition in order to improve its odor and general aesthetics. Antifoamers, or the like, can be added as well.

When the oil emulsifier, water emulsifier, ester solvent and lubricant are combined, it is believed that no chemical reaction occurs. However, the resulting emulsion is in a carefully selected hydrophilic-hydrophobic balance, making the composition water dispersible. In particular, the composition is removable from metallic surfaces using only water. The composition can be removed by spraying water onto the metallic substrate, dipping the substrate into a vessel of water or by any other similar means. Preferably, the water is slightly heated to a temperature of 75° to 80° F., although the water temperature is not a critical factor.

While not limited thereto, one particular application of the lubricant composition of the present invention is in treating non-ferrous metals prior to or during a drawing process. Drawing refers to a process in which a metal substrate is forced through a die assembly to modify its cross-sectional area. In many drawing operations, the metal substrate is in the form of a wire, a rod, or a tube. The lubricant composition is applied to the metal substrate as it is forced through the die assembly.

Referring to FIG. 1, one example of a continuous lubricating and drawing process for non-ferrous metal tubing is illustrated. The apparatus includes a diameter modification station generally 10 and a washing station generally 12. At diameter modifying station 10, a die assembly 14 is positioned for receiving an indeterminate length of tube 16 made from a non-ferrous metal or alloy, such as aluminum. Die assembly 14 consists of a case hardened steel die mounted on a holding bracket. The apparatus is commercial and does not form a part of the present invention.

A lubricating composition according to the present invention is continuously fed to die assembly 14 from a reservoir 18. More particularly, the lubricating composition is pumped from reservoir 18 by a circulating pump 20 through a feed line 22. From feed line 22, the composition enters and floods die assembly 14 where non-ferrous tube 16 is lubricated as it is being drawn. Excess lubricant from die 14 is collected by catch basin 24 and is directed into drain line 26. From drain line 26, the lubricating composition returns to reservoir 18 for further recirculation and use.

Passing through die assembly 14, the outside diameter of non-ferrous tube 16, in this example, is reduced. In some applications, the outside diameter is decreased by as much as 20 percent dependent upon process set up and conditions. The draw speed for drawing aluminum is typically around two meters per second while the temperature of the metal is about 150° F. to 200° F. The lubricating composition facilitates the modification of the metal and prevents the tubing from becoming damaged.

After leaving die assembly 14, the reduced diameter tubing 16 which continues to be coated with the lubricant is continuously fed through a washing station 12 where the lubricant is removed. As shown, washing station 12 includes a water line 28 which branches off into a plurality of spray lines 30. Each spray line 30 includes a nozzle 32 which sprays water, preferably warm water, onto the tubing for removing the lubricant composition. By using the composition of the present invention, hazardous solvents are no longer needed to remove the lubricant.

Once the tubing is sprayed, waste water is collected in a catch basin 34 and discharged to a drain line 36. Because the composition of the present invention is environmentally safe, drain line 36 can feed directly into the sewer.

Some drawing processes require multi-stage metal treatment. In these types of processes, the dual station setup depicted in FIG. 1 may be repeated as many as six times and tied together in tandem. The cross-sectional area of the substrate is then reduced or modified a certain percentage at each successive station.

EXAMPLES

The following formulations have been found to be particularly successful not only in lubricating non-ferrous metals and alloys but in their ability to be removed from the metallic materials using only water. The formulations are commercially available from Alko America located in Lancaster, S.C. In particular, the formulations have been used to treat an aluminum wrapping surrounding a fiber optic cable. The aluminum wrapping was drawn down to a particular diameter using the following compositions as lubricants. Butyl stearate was used as the non-ferrous lubricant although other lubricants could have been used.

The first composition had the following formulation:

| Component | Weight Percent |
|---|---|
| Mixture of Dimethyl Esters | 10.0 |
| Ethoxylated Castor Oil | 10.0 |
| Isopropylamine Salt of Dodecylbenzene Sulfonic Acid | 20.0 |
| Non-Ferrous Lubricant | 60.0 |

Another example of lubricant compositions according to the present invention includes:

| Component | Weight Percent |
|---|---|
| Mixture of Dimethyl Esters | 8.2 |
| Ethoxylated Castor Oil | 8.3 |
| Isopropylamine Salt of Dodecylbenzene Sulfonic Acid | 18.3 |
| Non-Ferrous Lubricant | 65.0 |
| Wintergreen | 0.2 |

The above formulations have a pH between about 6.0 to about 7.0. The viscosity of the compositions ranges between about 25 centipoise to about 35 centipoise.

In combining the ingredients, the dialkyl esters should be first emulsified before being blended with the lubricant. In formulating the above compositions, the oil emulsifier and water emulsifier were first combined in a clean tank and mixed. The dialkyl esters were then added and mixed with the emulsifiers to form an emulsion. The lubricant, butyl stearate, was then added to the tank and mixed with the other ingredients thoroughly until the composition appeared clear.

The above formulations are offered only for exemplary purposes and are not intended to limit the broader aspects of the present invention.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention as defined in the following claims.

What is claim:

1. A composition for lubricating non-ferrous metallic materials in a metal working process comprising a stable emulsion containing an ester solvent, a lubricant for the non-ferrous metal and at least one emulsifier, said at least one emulsifier comprising a water dispersible emulsifier, said ester solvent containing a dialkyl ester, said ester solvent being present in said composition in an amount sufficient to make said composition water dispersible, said composition having a pH of up to about 7.0.

2. A composition as defined in claim 1, wherein said ester solvent comprises a mixture of dialkyl esters.

3. A composition as defined in claim 1, wherein said composition further comprises a nonionic or anionic emulsifier.

4. A composition as defined in claim 3, wherein said water dispersible emulsifier is an ethoxylated oil or oil derivative.

5. A composition as defined in claim 3, wherein said water dispersible emulsifier comprises an ethoxylated castor oil.

6. A composition as defined in claim 5, wherein said water dispersible emulsifier is present within said composition in relation to said ester solvent in a ratio within the range of approximately 0.5:1 to 1.5:1.

7. A composition as defined in claim 1, wherein said lubricant is a material selected from the group consisting of an ester of pentaerythritol, a fatty acid ester, a trimethylolpropane ester, a dimer diol ester, and mixtures thereof.

8. A composition as defined in claim 4, wherein said nonionic or anionic emulsifier is an amine salt condensate.

9. A composition used to lubricate non-ferrous metallic materials during metal processes, said composition being biodegradeable and removable from said metallic materials using only water, said composition having a pH of up to about 7.0 and comprising a stable emulsion including:

a lubricant being present within said composition in an amount from about 40 percent to about 80 percent by weight;

an ester solvent blended with said lubricant, said ester solvent comprising at least one dialkyl ester, said ester being present within said composition in an amount from about 3 percent to about 20 percent by weight; and a blend of emulsifiers, said emulsifiers comprising a water dispersible emulsifier and an anionic or nonionic emulsifier.

10. A composition as defined in claim 9, wherein said at least one dialkyl ester is a mixture of dimethyl esters.

11. A composition as defined in claim 9, wherein said nonionic or anionic emulsifier is a material selected from the group consisting of an amine salt of methyl benzene sulfonic acid, an isopropylamine salt of dodecylbenzene sulfonic acid, and mixtures thereof.

12. A composition as defined in claim 9, wherein said lubricant is a material selected from the group consisting of an ester of pentaerythritol, a fatty acid ester, a trimethylopropane ester, a dimer diol ester, and mixtures thereof.

13. A composition as defined in claim 9, wherein said water dispersible emulsifier is an ethoxylated oil or oil derivative.

14. A composition as defined in claim 9, wherein said water dispersible emulsifier comprises an ethoxylated castor oil.

15. An emulsified composition used for treating non-ferrous metallic materials during metal working processes, said composition being biodegradable and water dispersible, said lubricating composition comprising:

an ester solvent, said solvent comprising a mixture of dimethyl esters;

an initially water insoluble lubricant, said lubricant being blended with said ester solvent; and a blend of emulsifiers for emulsifying said ester solvent and lubricant mixture, said blend of emulsifiers containing an ethoxylated castor oil and an amine salt condensate of a sulfonic acid.

16. A lubricating composition as defined in claim 15, wherein said mixture of dimethyl esters is present within said composition in an amount from about 5 percent to about 15 percent by weight.

17. A lubricating composition as defined in claim 15, wherein said ethoxylated castor oil is present within said composition in relation to said mixture of dimethyl esters in a ratio within the range of approximately 0.5:1 to 1.5:1.

18. A lubricating composition as defined in claim 15, wherein said lubricant is a material selected from the group consisting of butyl stearate and esters of pentaerythritol.

19. A lubricating composition as defined in claim 15, wherein said lubricant is present within said composition in an amount from about 40 percent to about 70 percent by weight.

20. A lubricating composition as defined in claim 15, wherein said amine salt condensate of a sulfonic acid is an isopropylamine salt of dodecylbenzene sulfonic acid and is present within said composition in relation to said mixture of dimethyl esters in a ratio within the range of approximately 1.5:1 to 2.5:1.

21. A process for working non-ferrous metals, said process comprising the steps of:

supplying a non-ferrous metal substrate;

contacting said non-ferrous metal substrate with a lubricating composition, said composition having a pH of up to about 7.0 and comprising a stable emulsion containing an ester solvent, a lubricant for the non-ferrous metal, a water dispersible emulsifier, and an anionic or nonionic emulsifier, said ester solvent containing a dialkyl ester, said ester solvent being present in said composition in an amount sufficient to make said composition water dispersible; and working said lubricated non-ferrous metal substrate in order to modify the shape of said substrate.

22. A process as defined in claim 21, further comprising the step of washing said lubricated non-ferrous metal substrate with water after said substrate has been modified to remove said lubricating composition.

23. A composition for lubricating non-ferrous metallic materials in a metal working process comprising a stable emulsion containing an ester solvent and a lubricant for the non-ferrous metal, said lubricant comprising butyl stearate, said ester solvent containing a dialkyl ester, said ester solvent being present in said composition in an amount sufficient to make said composition water dispersible.

24. A composition as defined in claim 9, wherein said lubricant is butyl stearate.

25. A process as defined in claim 21, wherein said water dispersible emulsifier comprises an ethoxylated castor oil.

26. A process as defined in claim 21, wherein said lubricant for the non-ferrous metal comprises a material selected from the group consisting of an ester of pentaerythritol, a fatty acid ester, a trimethylolpropane ester, a dimer diol ester, and mixtures thereof.

* * * * *